US006951498B2

(12) United States Patent
Rudell

(10) Patent No.: US 6,951,498 B2
(45) **Date of Patent: *Oct. 4, 2005**

(54) VEHICLE PLAYSET WITH REMOTE CONTROL

(76) Inventor: Elliot Rudell, 1619 Gramercy Ave., Torrance, CA (US) 90501

( * ) Notice: Subject to any disclaimer, the term of this patent is extended or adjusted under 35 U.S.C. 154(b) by 0 days.

This patent is subject to a terminal disclaimer.

(21) Appl. No.: 10/725,655

(22) Filed: Dec. 1, 2003

(65) Prior Publication Data

US 2004/0192162 A1 Sep. 30, 2004

Related U.S. Application Data

(63) Continuation of application No. 10/465,379, filed on Jun. 18, 2003, now Pat. No. 6,733,361.
(60) Provisional application No. 60/458,187, filed on Mar. 26, 2003.

(51) Int. Cl.[7] ..... A63H 30/00
(52) U.S. Cl. ..... 446/454; 446/444; 446/456; 238/10 E; 463/63
(58) Field of Search ..... 446/77, 78, 95, 446/96, 431, 409, 410, 441, 444, 445, 448, 465, 454–457; 463/63, 62; 238/10 A, 10 B, 10 C, 10 E, 10 F

(56) References Cited

U.S. PATENT DOCUMENTS

| | | | | | |
|---|---|---|---|---|---|
| 4,295,649 | A | * | 10/1981 | Cooper | 463/59 |
| 4,377,918 | A | * | 3/1983 | Zbriger | 446/444 |
| 4,401,305 | A | * | 8/1983 | Sano | 463/59 |
| 4,479,650 | A | * | 10/1984 | Neuhierl | 463/63 |
| 4,568,300 | A | * | 2/1986 | Rasmussen et al. | 446/129 |
| 5,203,733 | A | * | 4/1993 | Patch et al. | 446/444 |
| 5,452,893 | A | * | 9/1995 | Faulk et al. | 463/68 |
| 5,749,547 | A | * | 5/1998 | Young et al. | 246/4 |

* cited by examiner

*Primary Examiner*—Bena Miller
(74) *Attorney, Agent, or Firm*—Ben J. Yorks, Esq.; Irell & Manella LLP

(57) ABSTRACT

A wireless toy playset. The playset includes a small size vehicle that moves about a track. Movement of the vehicle is controlled by a wireless transmitter. At the discretion of a parent or end user the transmitter can either be structurally coupled to the track or physically separated from the track. By way of example, the transmitter may be docked into a docking station of the track. Structurally coupling the wireless transmitter to the track reduces the likelihood of separation, and possibly misplacement, of the transmitter from the playset. For example, when the playset is operated by a small child it may be desirable to structurally couple the wireless transmitter to the track to prevent the child from removing and losing the transmitter. When the child is older the transmitter may be removed from the track

10 Claims, 2 Drawing Sheets

VEHICLE PLAYSET WITH REMOTE CONTROL

REFERENCE TO CROSS RELATED APPLICATIONS

This application claims priority under 35 U.S.C. §119(e) to application Ser. No. 60/458,187, filed on Mar. 26, 2003 and is a continuation of application Ser. No. 10/465,379, filed Jun. 18, 2003; U.S. Pat. No. 6,733,361.

BACKGROUND OF THE INVENTION

1. Field of the Invention

The present invention relates to a wireless signal controlled toy playset.

2. Background Information

There have been developed a number of wireless signal controlled toy playsets. Wireless toy playsets typically include a wireless transmitter that can be operated by an end user to control the movement of a motorized toy vehicle. For example, there had been developed wireless signal controlled hand size playsets marketed by Fisher-Price under the trademarks RC RACEWAY and RC OFF-ROAD ADVENTURE that contained motorized vehicle that moved about a track. The vehicles were controlled by buttons of a wireless transmitter. U.S. Pat. No. 5,816,887 issued to Rudell et al., discloses a small size train set that is controlled by a wireless transmitter. The transmitter includes a button to control the speed of the train and a second button to activate an auxiliary feature such as a barrel loading feature of the train set.

The transmitters for the small size wireless toys are physically separate from the vehicles or tracks. Consequently, a child may misplace, lose, or otherwise permanently separate the transmitter from the vehicle, rendering the playset inoperative.

Tyco Preschool, which became a part of Fisher Price, marketed a line of wireless controlled toys under the SESAME STREET brand. One of the Tyco toys was a ride-on train marketed under the trademark FP RADIO CONTROL RIDE-ON TRAIN. The RIDE-ON TRAIN was large enough for a young child to ride.

The RIDE-ON TRAIN included a wireless transmitter that could be held and operated by a parent while the child held onto the train. When the child attained a certain level of motor skills the transmitter could be attached directly to the train so that the child could control the motion of the toy train. In this configuration the child would have to ride the train to operate the transmitter. This would be an impossibility for a small size playset such as the RC RACEWAY and RC OFF-ROAD ADVENTURE products. It would be desirable to have a toy playset that would minimize the possibility of losing the transmitter while allowing the end user to operate the transmitter without sitting on the vehicle. It would also be desirable to allow an end user to operate a wireless transmitter located adjacent to the track.

BRIEF SUMMARY OF THE INVENTION

A toy playset with a wireless transmitter that controls the movement of a small size vehicle about a track. The wireless transmitter is structurally coupled to the track.

DETAILED DESCRIPTION

Disclosed is a wireless toy playset. The playset includes a small size vehicle that moves about a track. Movement of the vehicle is controlled by a wireless transmitter. At the discretion of a parent or end user the transmitter can either be structurally coupled to the track or physically separated from the track. By way of example, the transmitter may be docked into a docking station of the track. Structurally coupling the wireless transmitter to the track reduces the likelihood of separation, and possibly misplacement, of the transmitter from the playset. For example, when the playset is operated by a small child it may be desirable to structurally couple the wireless transmitter to the track to prevent the child from removing and losing the transmitter. When the child is older the transmitter may be removed from the track.

Figure 1:
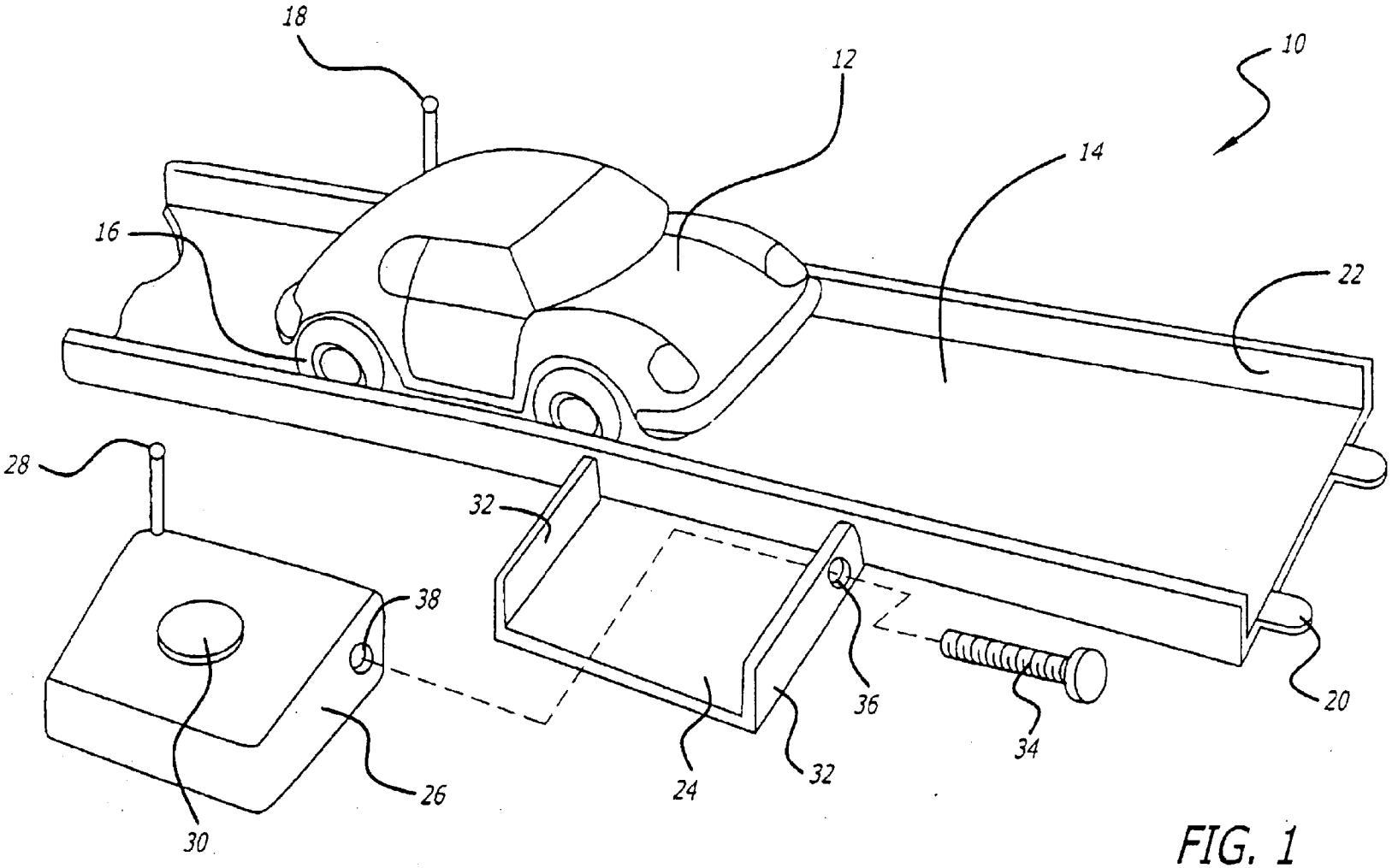
FIG. 1 is an illustration of an embodiment of a toy playset.

Referring to the drawings more particularly by reference numbers, FIG. 1 shows an embodiment of a toy playset 10. The playset 10 includes a small size toy vehicle 12 that can move along a track 14. The vehicle 12 may include a motor (not shown) that can turn one or more wheels 16. The motor may be coupled to a wireless receiver (not shown) within the vehicle 12. The receiver can be connected to an antennae 18. Small size vehicles are vehicles that are typically less than 16 inches long and 8 inches wide.

The track 14 may be constructed from a plurality of molded plastic piece parts that have interlocking tabs 20. The track 14 may be configured as a toy racetrack, or a roadway, with walls 22 that restrain the movement of the vehicle 12.

The track 14 may have a wireless transmitter docking station 24 that holds a wireless transmitter 26. The wireless transmitter 26 may include an antennae 28 that emits a wireless signal in response to an end user depressing a transmitter button 30. The wireless signal is received by the vehicle receiver that then activates the motor and propels the vehicle 12 across the track 14.

Although a button 30 is shown, it is to be understood that the transmitter 26 may have other types of input devices such as knobs or switches. The input devices may allow the end user to vary the speed of the vehicle 12. The wireless signal may be an electromagnetic signal in the radio frequency ("RF") range. Alternatively, the transmitter 26 may emit infrared ("IR") signals. It being understood that IR transmitters typically have to be "in sight" with the vehicle 12.

The docking station 24 may be integrated into one of the track piece parts and may have a pair of opposing walls 32. The playset 10 may include a fastener 34 that attaches the wireless transmitter 26 to the docking station 24. The fastener 34 may extend through a clearance hole 36 of a wall 32 and screw into a threaded aperture 38 of the transmitter 26. Alternatively, the docking station 24 may have a tab (not shown) that extends into a detent (not shown) of the transmitter 26, or have other attachment means that would not require a tool. Instead of fastener attachments, the wireless transmitter 26 may be held in place by frictional forces with the walls 32 wherein the transmitter 26 slides into the station 24. Alternatively, the transmitter 26 may be coupled to the station 24 by hook and loop material commonly referred to as Velcro.

In operation, the piece parts can be snapped together to form the track 14 or the track can be one complete unit. For young users the transmitter 26 may be mechanically coupled to the docking station 24. Once secured to the docking station 24 the user is less likely to lose or otherwise separate the transmitter 26 from the rest of the playset 10. For older users the transmitter 26 may be operated outside of the docking station 24. In or out of the docking station, the user can control the movement of the vehicle 12 about the track 14 through the wireless transmitter 26.

Figure 2:
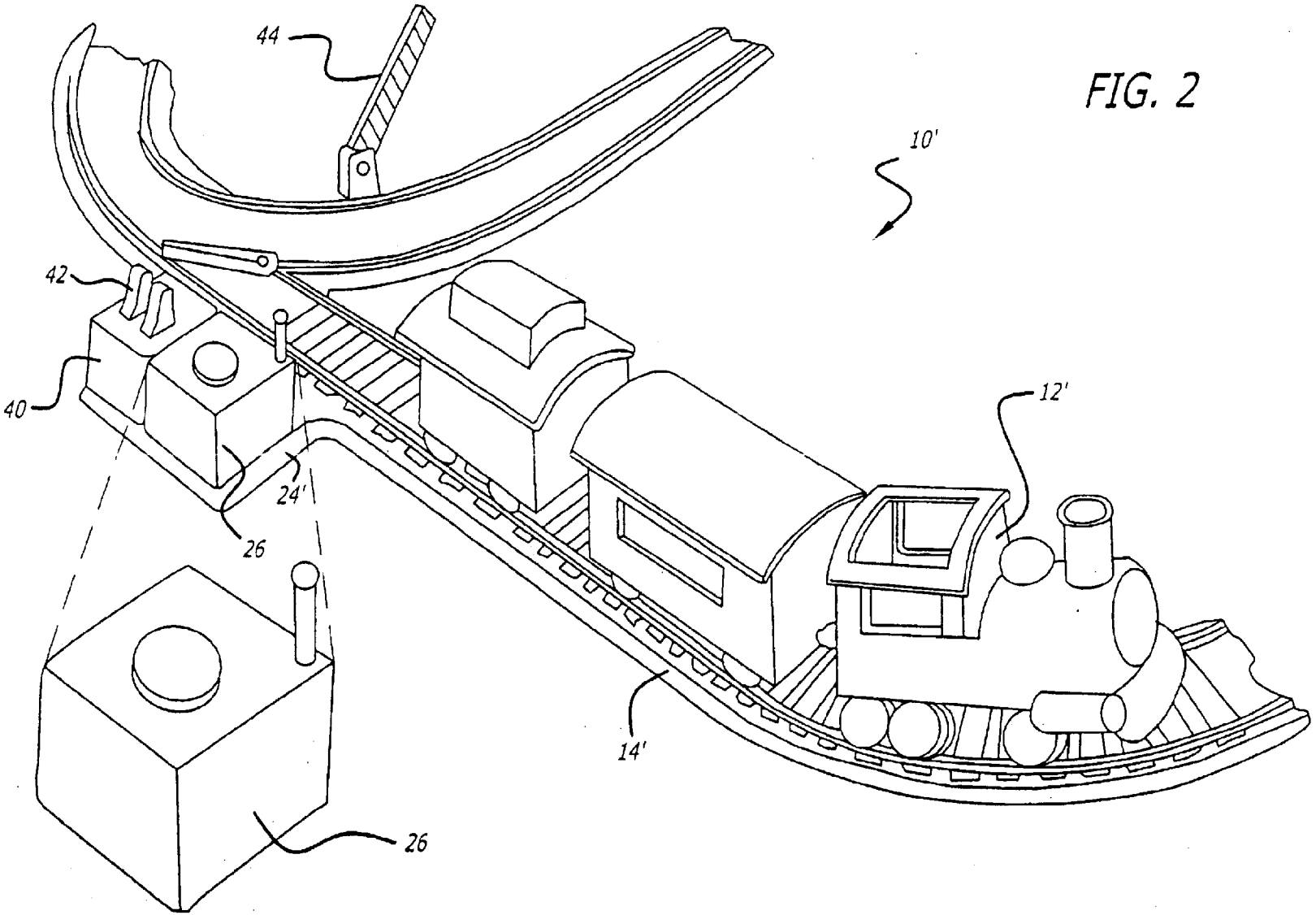
FIG. 2 is an illustration of an alternate embodiment of a toy playset.

FIG. 2 shows an alternate embodiment of a toy playset 10'. In this embodiment, the vehicle 12' is shaped as a train and the track 14' is configured as a train track. The playset 10' includes a wireless transmitter 26 that can be secured within a docking station 24' that is part of the track 14'. The docking station 24' may contain another controller 40 that has levers 42 used to control other functions such as the lifting of track gates 44. The wireless transmitter 26 can be operated either within the docking station 24' or outside the docking station 24'. Although not shown, the docking station 24' may include fasteners, or detent tabs, etc. for coupling the transmitter 26 to the station 24'.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A toy playset, comprising:

a track that is constructed from a plurality of individual track pieces that each have interlocking tabs;

a wirelessly controlled small size vehicle that moves about said track; and, a wireless transmitter structurally coupled to said track.

2. The toy playset of claim 1, further comprising a fastener that attaches said wireless transmitter to said track.

3. The toy playset of claim 1, wherein said wirelessly controlled small size vehicle is shaped to simulate an automobile.

4. The toy playset of claim 1, wherein said wirelessly controlled small size vehicle is shaped to simulate a train.

5. The toy playset of claim 1, wherein said wirelessly controlled small size vehicle is less than 16 inches long and 8 inches wide.

6. A toy playset, comprising:

a track that has a docking station and is constructed from a plurality of individual track pieces that each have interlocking tabs;

a wirelessly controlled small size vehicle that moves about said track; and, a wireless transmitter.

7. The toy playset of claim 6, wherein said wireless transmitter is attached to said docking station.

8. The toy playset of claim 6, wherein said wirelessly controlled small size vehicle is shaped to simulate an automobile.

9. The toy playset of claim 6, wherein said wirelessly controlled small size vehicle is shaped to simulate a train.

10. The toy playset of claim 6, wherein said wirelessly controlled small size vehicle is less than 16 inches long and 8 inches wide.

* * * * *